US008245697B2

(12) United States Patent
Biasci et al.

(10) Patent No.: US 8,245,697 B2
(45) Date of Patent: Aug. 21, 2012

(54) COUPLING DEVICE

(75) Inventors: Enio Biasci, Campo (IT); Edoardo Giorgetti, Rosignano Marittimo (IT); Daniel Marc, Livorno (IT); Giandomenico Serra, Pisa (IT)

(73) Assignee: Continental Automotive GmbH, Hannover (DE)

( * ) Notice: Subject to any disclaimer, the term of this patent is extended or adjusted under 35 U.S.C. 154(b) by 281 days.

(21) Appl. No.: 12/687,588

(22) Filed: Jan. 14, 2010

(65) Prior Publication Data

US 2010/0170477 A1 Jul. 8, 2010

(30) Foreign Application Priority Data

Jan. 19, 2009 (EP) ..... 09000673

(51) Int. Cl.
*F02M 61/14* (2006.01)
*F02M 61/18* (2006.01)

(52) U.S. Cl. ..... 123/470; 123/456

(58) Field of Classification Search ..... 123/470, 123/468, 469, 456; 239/600; 285/319, 305, 285/348

See application file for complete search history.

(56) References Cited

U.S. PATENT DOCUMENTS

| | | | | |
|---|---|---|---|---|
| 749,496 | A | 1/1904 | Patterson et al. | 285/67 |
| 2,950,130 | A | 8/1960 | Schneider | 285/67 |
| 3,260,539 | A | 7/1966 | Herron | 285/24 |
| 3,414,297 | A | 12/1968 | Pollia | 285/98 |
| 3,861,722 | A | 1/1975 | Kenyon | 285/337 |
| 3,885,895 | A | 5/1975 | Staudt et al. | 417/499 |
| 3,908,621 | A | 9/1975 | Hussey | 123/139 |
| 3,966,234 | A | 6/1976 | Sundholm | 285/24 |
| 4,143,625 | A | 3/1979 | Kulke | 123/32 |
| 4,213,564 | A | 7/1980 | Hulsing | 239/88 |
| 4,295,452 | A | 10/1981 | Lembke et al. | 123/470 |
| 4,488,743 | A | 12/1984 | Schülke | 285/368 |
| 4,878,037 | A | 10/1989 | Mathews et al. | 333/254 |
| 4,982,983 | A | 1/1991 | Lenzi et al. | 285/281 |
| 5,024,198 | A * | 6/1991 | Usui | 123/468 |
| 5,038,738 | A | 8/1991 | Hafner et al. | 123/470 |

(Continued)

FOREIGN PATENT DOCUMENTS

DE 19941770 3/2001

(Continued)

OTHER PUBLICATIONS

Extended European Search Report, European application No. 09000673.5-2311, 6 pages, mailed Jun. 29, 2009.

(Continued)

*Primary Examiner* — Mahmoud Gimie
(74) *Attorney, Agent, or Firm* — King & Spalding L.L.P.

(57) ABSTRACT

Coupling device for hydraulically and mechanically coupling a fuel injector to a fuel rail of a combustion engine. The fuel injector has a central longitudinal axis. The coupling device has a fuel injector cup being designed to be hydraulically coupled to the fuel rail and to engage a fuel inlet portion of the fuel injector, a first plate element being fixedly coupled to the fuel injector cup, the first plate element comprising a recess, and a second plate element being fixedly coupled to the fuel injector and being arranged in the recess and being fixedly coupled to the first plate element to retain the fuel injector in the fuel injector cup in direction of the central longitudinal axis. The fuel injector comprises a groove. A snap ring is arranged in the groove of the fuel injector and is designed to fixedly couple the second plate element to the fuel injector.

18 Claims, 3 Drawing Sheets

U.S. PATENT DOCUMENTS

| | | | | |
|---|---|---|---|---|
| 5,209,204 | A | 5/1993 | Bodenhausen et al. | 123/470 |
| 5,301,647 | A | 4/1994 | Lorraine | 123/470 |
| 5,394,850 | A | 3/1995 | Murphy et al. | 123/470 |
| 5,499,612 | A | 3/1996 | Haughney et al. | 123/470 |
| 5,765,534 | A | 6/1998 | Brown et al. | 123/470 |
| 5,803,513 | A | 9/1998 | Richardson | 285/342 |
| 5,842,450 | A | 12/1998 | Fort et al. | 123/463 |
| 5,934,253 | A | 8/1999 | Kojima et al. | 123/470 |
| 5,943,995 | A | 8/1999 | Niwa et al. | 123/470 |
| 6,102,007 | A * | 8/2000 | Furst | 123/469 |
| 6,176,221 | B1 | 1/2001 | Hofmann | 123/470 |
| 6,223,727 | B1 * | 5/2001 | Tahara et al. | 123/470 |
| 6,227,785 | B1 | 5/2001 | Kilgore | 411/526 |
| 6,237,571 | B1 | 5/2001 | Harrison | 123/469 |
| 6,314,943 | B1 * | 11/2001 | Burch et al. | 123/470 |
| 6,431,151 | B1 | 8/2002 | Gmelin | 123/470 |
| 6,499,468 | B1 | 12/2002 | Ferraro et al. | 123/470 |
| 6,543,421 | B2 | 4/2003 | Lorraine et al. | 123/470 |
| 6,715,802 | B2 | 4/2004 | Baker | 285/368 |
| 6,718,949 | B2 | 4/2004 | Gmelin | 123/470 |
| 6,745,753 | B2 | 6/2004 | Spinnler et al. | 123/509 |
| 6,830,034 | B2 * | 12/2004 | Engelmeyer et al. | 123/470 |
| 6,830,036 | B2 | 12/2004 | Okajima et al. | 123/470 |
| 6,860,008 | B2 | 3/2005 | Bodenhausen et al. | 29/855 |
| 6,877,484 | B2 | 4/2005 | Reiter | 123/468 |
| 6,923,162 | B2 | 8/2005 | Reiter | 123/490 |
| 7,063,075 | B2 | 6/2006 | Berger et al. | 123/470 |
| 7,188,611 | B2 * | 3/2007 | Schmieder | 123/469 |
| 7,195,003 | B2 | 3/2007 | Liskow | 123/470 |
| 7,334,571 | B1 | 2/2008 | Beardmore | 123/470 |
| 7,445,252 | B2 | 11/2008 | Ho | 285/409 |
| 7,516,735 | B1 | 4/2009 | Doherty et al. | 123/468 |
| 7,591,489 | B2 | 9/2009 | Woo | 285/365 |
| 7,765,984 | B2 | 8/2010 | Fuerst et al. | 123/456 |
| 7,828,338 | B2 | 11/2010 | Kertesz et al. | 285/365 |
| 7,861,692 | B2 | 1/2011 | Biasci et al. | 123/470 |
| 7,934,488 | B2 | 5/2011 | Biasci et al. | 123/470 |
| 2002/0100456 | A1 | 8/2002 | Panasuk et al. | 123/456 |
| 2005/0284449 | A1 * | 12/2005 | Zdroik | 123/516 |
| 2008/0042434 | A1 | 2/2008 | Kenny | 285/354 |
| 2008/0169364 | A1 | 7/2008 | Zdroik et al. | 239/533.2 |
| 2008/0216798 | A1 * | 9/2008 | Ghelardi et al. | 123/470 |
| 2009/0173317 | A1 | 7/2009 | Doherty et al. | 123/470 |
| 2009/0229575 | A1 | 9/2009 | Giorgetti et al. | 123/470 |
| 2009/0229576 | A1 | 9/2009 | Biasci et al. | 123/470 |
| 2010/0012093 | A1 | 1/2010 | Pepperine et al. | 123/470 |
| 2010/0018502 | A1 | 1/2010 | Fischetti et al. | 123/470 |
| 2010/0192913 | A1 | 8/2010 | Keidel et al. | 123/470 |

FOREIGN PATENT DOCUMENTS

| | | | |
|---|---|---|---|
| DE | 10108203 | | 8/2002 |
| DE | 102004037117 | | 3/2006 |
| DE | 102005020380 | A1 | 11/2006 |
| DE | 102005024044 | A1 | 11/2006 |
| DE | 102006042597 | | 3/2008 |
| EP | 1255038 | | 11/2002 |
| EP | 1279825 | A2 | 1/2003 |
| EP | 1460264 | | 9/2004 |
| EP | 1818535 | | 8/2007 |
| FR | 2637021 | | 3/1990 |
| FR | 2872252 | | 12/2005 |
| GB | 2024937 | | 1/1980 |
| JP | 1096464 | | 4/1989 |
| WO | 01/18384 | A1 | 3/2001 |
| WO | 03038267 | | 5/2003 |
| WO | 03046370 | | 6/2003 |
| WO | 2006/092427 | A1 | 9/2006 |

OTHER PUBLICATIONS

Extended European Search Report, EP Application No. 09000673.5-2311, 6 pages, Jun. 29, 2006.

* cited by examiner

COUPLING DEVICE

CROSS-REFERENCE TO RELATED APPLICATIONS

This application claims priority to EP Patent Application No. 09000673 filed Jan. 19, 2009, the contents of which is incorporated herein by reference in its entirety.

TECHNICAL FIELD

The invention relates to a coupling device for hydraulically and mechanically coupling a fuel injector to a fuel rail of a combustion engine.

BACKGROUND

Coupling devices for hydraulically and mechanically coupling a fuel injector to a fuel rail are in widespread use, in particular for internal combustion engines. Fuel can be supplied to an internal combustion engine by the fuel rail assembly through the fuel injector. The fuel injectors can be coupled to the fuel injector cups in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Known fuel rails comprise a hollow body with recesses in form of fuel injector cups, wherein the fuel injectors are arranged. The connection of the fuel injectors to the fuel injector cups that supply the fuel from a fuel tank via a low or high-pressure fuel pump needs to be very precise to get a correct injection angle and a sealing of the fuel.

EP 1 279 825 A2 discloses a distributor with a chamber connected to a fuel source. The distributor has an injector body comprising a coupling element with a ring shaped projection. The injector body is coupled to an injector cup by the coupling element.

SUMMARY

According to various embodiments, a coupling device for hydraulically and mechanically coupling a fuel injector to a fuel rail can be created which is simply to be manufactured and which facilitates a reliable and precise connection between the fuel injector and the fuel injector cup without a resting of the fuel injector on the cylinder head.

According to an embodiment, a coupling device for hydraulically and mechanically coupling a fuel injector to a fuel rail of a combustion engine, the fuel injector having a central longitudinal axis, may comprise a fuel injector cup operable to be hydraulically coupled to the fuel rail and to engage a fuel inlet portion of the fuel injector, a first plate element being fixedly coupled to the fuel injector cup, the first plate element comprising a recess, and a second plate element being fixedly coupled to the fuel injector and being arranged in the recess and being fixedly coupled to the first plate element to retain the fuel injector in the fuel injector cup in direction of the central longitudinal axis, wherein the fuel injector comprises a groove, and a snap ring is arranged in the groove of the fuel injector and is designed to fixedly couple the second plate element to the fuel injector.

According to a further embodiment, the second plate element and the recess may be shaped in a manner that the second plate element and the recess are forming a positive fitting coupling. According to a further embodiment, the second plate element and the recess may be shaped in a manner that the second plate element and the recess are forming a torque proof coupling. According to a further embodiment, the groove of the fuel injector and the snap ring can be arranged and designed to form a positive fitting coupling between the second plate element and the fuel injector which is designed to prevent a movement of the second plate element relative to the fuel injector. According to a further embodiment, the first plate element can be in one part with the fuel injector cup. According to a further embodiment, the coupling device may comprise a single screw element, and the plate elements being designed and arranged to be fixedly coupled with the single screw element.

BRIEF DESCRIPTION OF THE DRAWINGS

Exemplary embodiments are explained in the following with the aid of schematic drawings. These are as follows.

Elements of the same design and function that occur in different illustrations are identified by the same reference character.

DETAILED DESCRIPTION

Figure 1:
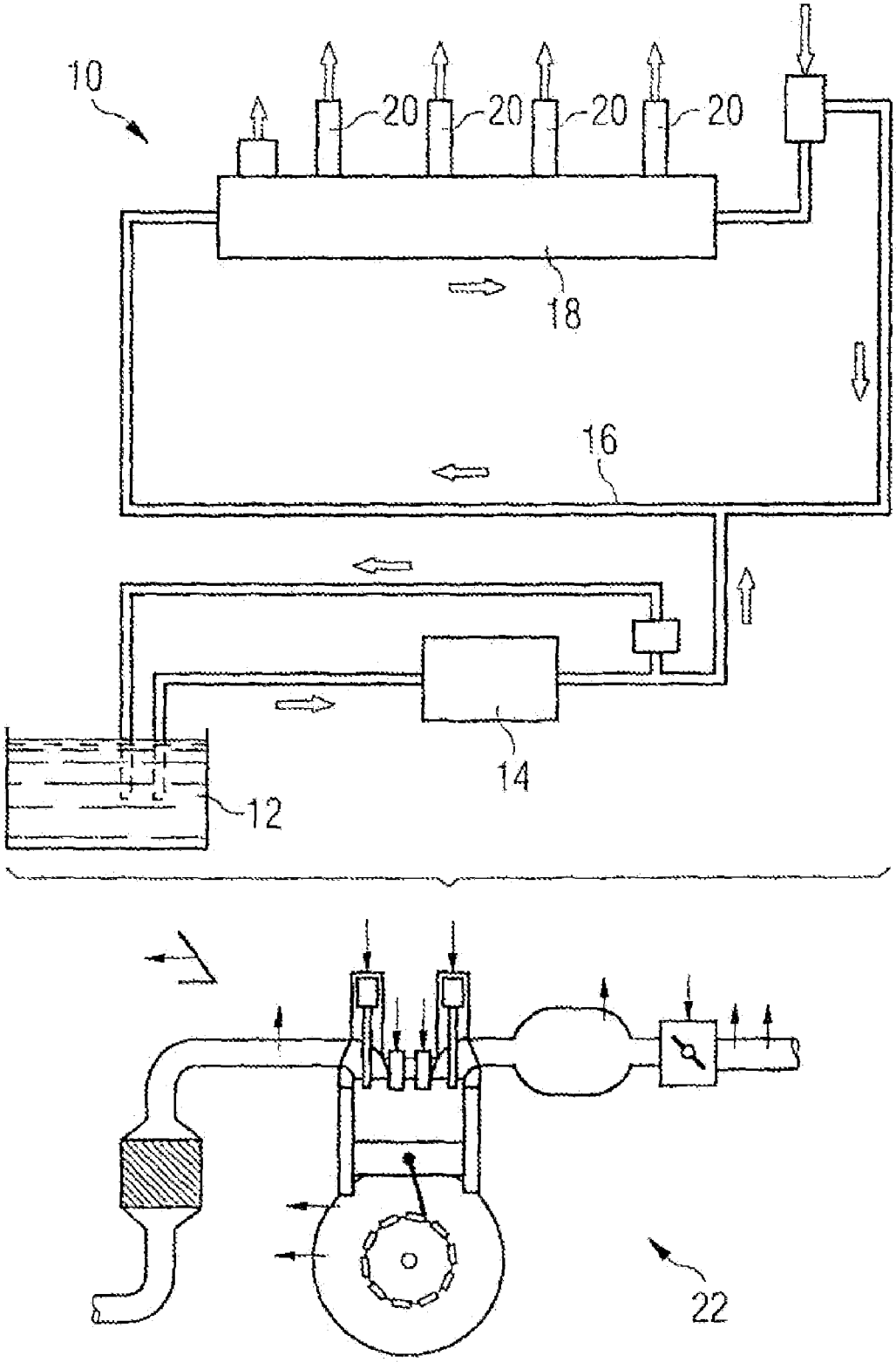
FIG. 1 an internal combustion engine in a schematic view.

According to various embodiments, a coupling device for hydraulically and mechanically coupling a fuel injector to a fuel rail of a combustion engine, the fuel injector having a central longitudinal axis, may comprise a fuel injector cup being designed to be hydraulically coupled to the fuel rail and to engage a fuel inlet portion of the fuel injector, a first plate element being fixedly coupled to the fuel injector cup, the first plate element comprising a recess, and a second plate element being fixedly coupled to the fuel injector and being arranged in the recess and being fixedly coupled to the first plate element to retain the fuel injector in the fuel injector cup in direction of the central longitudinal axis. The fuel injector comprises a groove. A snap ring is arranged in the groove of the fuel injector and is designed to fixedly couple the second plate element to the fuel injector.

This has the advantage that a fast and secure coupling of the fuel injector in the fuel injector cup is possible. Furthermore, the coupling of the fuel injector with the fuel rail by the plate elements of the fuel injector and the fuel injector cup allows an assembly of the fuel injector and the fuel rail without a further metallic contact between the fuel injector and further parts of the combustion engine. Consequently, a noise transmission between the fuel injector and further parts of the combustion engine can be kept small.

In an embodiment the second plate element and the recess are shaped in a manner that the second plate element and the recess are forming a positive fitting coupling. By this a secure coupling of the second plate element to the fuel injector cup is enabled.

In a further embodiment the second plate element and the recess are shaped in a manner that the second plate element and the recess are forming a torque proof coupling. By this a rotation or deflection of the fuel injector cup relative to the second plate element can be avoided.

In a further embodiment the groove of the fuel injector and the snap ring are arranged and designed to form a positive fitting coupling between the second plate element and the fuel injector which is designed to prevent a movement of the second plate element relative to the fuel injector. By this a secure coupling of the second plate element to the fuel injector is enabled.

In a further embodiment the first plate element is in one part with the fuel injector cup. This has the advantage that a very secure coupling of the fuel injector to the fuel injector cup is possible. Furthermore, a simple machining of the first plate element together with the fuel injector cup is possible.

In a further embodiment the coupling device comprises a single screw element, and the plate elements are designed and arranged to be fixedly coupled with the single screw element. This has the advantage that a simple construction of the coupling device is possible which allows carrying out a fast and secure coupling of the fuel injector in the fuel injector cup. Furthermore, a defined positioning of the fuel injector relative to the fuel injector cup in axial and circumferential direction is enabled. In particular, in the case that the second plate element and the recess are forming a torque proof coupling the single screw is sufficient to guarantee a secure coupling of the fuel injector in the fuel injector cup.

A fuel feed device 10 is assigned to an internal combustion engine 22 (FIG. 1) which can be a diesel engine or a gasoline engine. It includes a fuel tank 12 that is connected via a first fuel line to a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about 2,000 bar in the case of a diesel engine. Fuel injectors 20 are connected to the fuel rail 18 and the fuel is fed to the fuel injectors 20 via the fuel rail 18.

Figure 2:
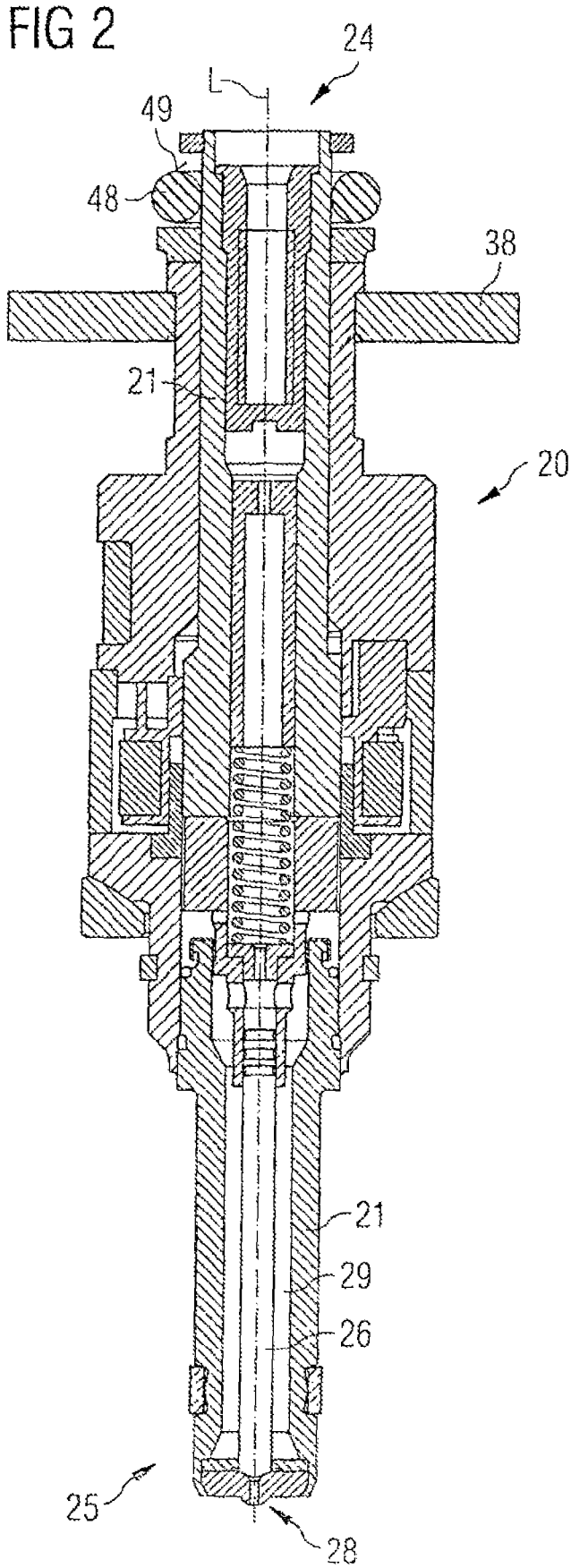
FIG. 2 a longitudinal section through a fuel injector.

FIG. 2 shows the fuel injector 20 with a central longitudinal axis L. The fuel injector 20 has a fuel injector body 21 and is suitable for injecting fuel into a combustion chamber of the internal combustion engine 22. The fuel injector 20 has a fuel inlet portion 24 and a fuel outlet portion 25.

Furthermore, the fuel injector 20 comprises a valve needle 26 taken in a cavity 29 of the fuel injector body 21. On a free end of the fuel injector 20 an injection nozzle 28 is formed which is closed or opened by an axial movement of the valve needle 26. In a closing position a fuel flow through the injection nozzle 28 is prevented. In an opening position fuel can flow through the injection nozzle 28 into the combustion chamber of the internal combustion engine 22.

Figure 3:
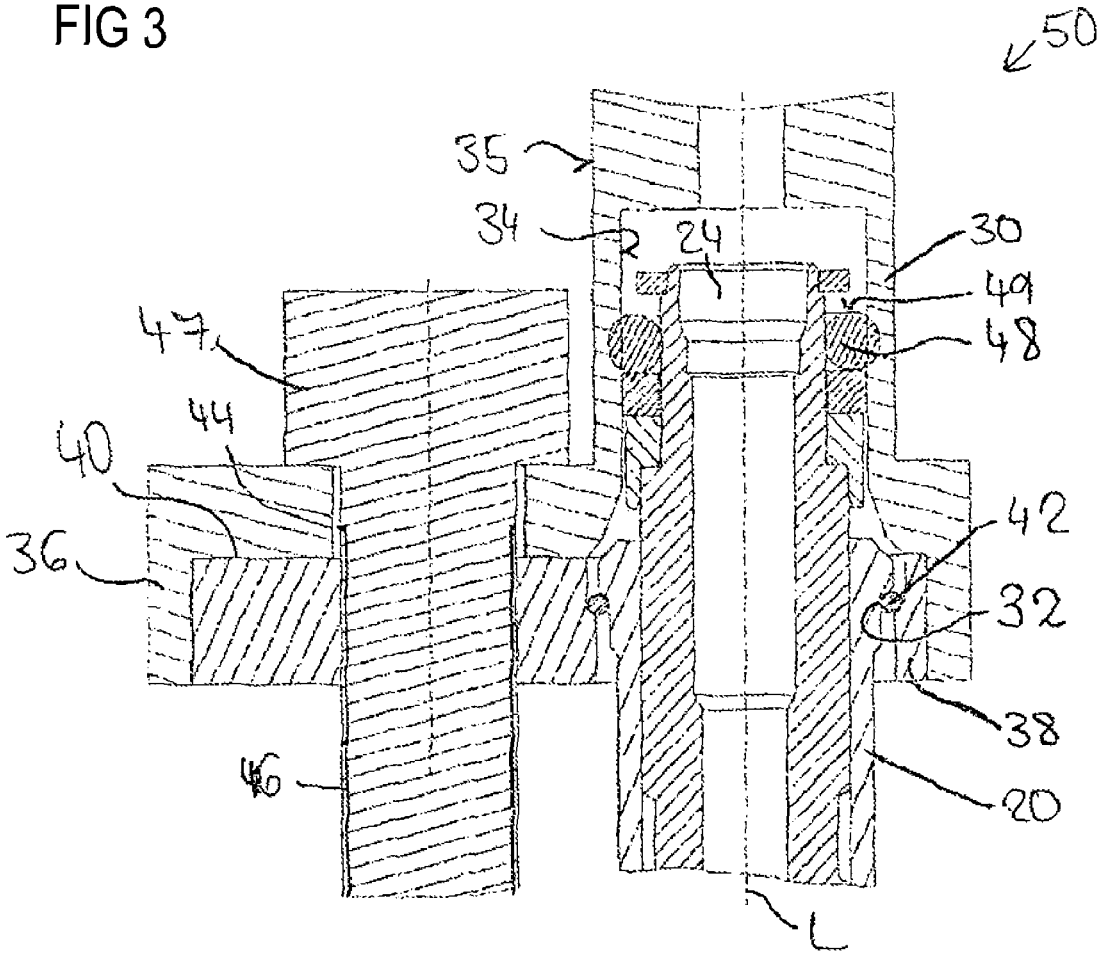
FIG. 3 a longitudinal section through a coupling device.

FIG. 3 shows a coupling device 50 which comprises the fuel injector 20. The coupling device 50 is designed to be coupled to the fuel rail 18 of the internal combustion engine 22. The coupling device 50 has a fuel injector cup 30, a first plate element 36 and a second plate element 38. The second plate element 38 has a recess 40. The first plate element 36 is arranged in the recess 40.

The fuel injector cup 30 comprises an inner surface 34 and an outer surface 35 and is hydraulically coupled to the fuel rail 18. Furthermore, the fuel injector cup 30 is in engagement with the fuel inlet portion 24 of the fuel injector 20. The fuel inlet portion 24 of the fuel injector 20 comprises a sealing ring 48 with an outer surface 49.

The first plate element 36 is in one part with the fuel injector cup 30. The second plate element 38 is fixedly coupled to the fuel injector 20. Preferably, the first plate element 36 may have a through hole 44 and the second plate element 38 has a thread 46.

The first plate element 36 and the second plate element 38 are fixedly coupled with each other by a screw element 47 which is received by the through hole 44 of the first plate element 36 and is screwed into the thread 46 of the second plate element 38. In the shown embodiment only a single screw element 47 is necessary to enable a secure torque free coupling between the second plate element 38 and the fuel injector cup 30.

As the second plate element 38 is fixedly coupled to the fuel injector 20 and the fuel injector cup 30 with the first plate element 36 is fixedly coupled to the second plate element 38 by the screw element 47, the fuel injector 20 is retained in the fuel injector cup 30 in direction of the central longitudinal axis L.

The fuel injector 20 has a groove 32. The coupling device 50 has a snap ring 42 which is arranged in the groove 32 of the fuel injector 20. The second plate element 38 is in engagement with the snap ring 42.

The snap ring 42 enables a positive fitting coupling between the second plate element 38 and the fuel injector 20 to prevent a movement of the second plate element 38 relative to the fuel injector 20 in a direction of the central longitudinal axis L. By this a very rigid and very secure coupling between the fuel injector cup 30 and the fuel injector 20 is possible.

In the following, the assembly and disassembly of the fuel injector 20 with the fuel injector cup 30 will be described:

For assembling, the snap ring 42 is shifted into the groove 32 of the fuel injector 20. Furthermore, the second plate element 38 is shifted over the fuel injector 20 until it is in a positive fitting coupling with the fuel injector 20 to prevent a movement of the second plate element 38 relative to the fuel injector 20 in the direction of the central longitudinal axis L.

Furthermore, the fuel inlet portion 24 of the fuel injector 20 is shifted into the fuel injector cup 30 in a way that the second plate element 38 is in engagement with the recess 40 of the first plate element 36. Then, the screw element 47 is screwed into the thread 36 of the second plate element 38 and a state as shown in FIG. 3 is obtained. As can be seen in FIG. 3, the inner surface 34 of the fuel injector cup 30 is in sealing engagement with the outer surface 49 of the sealing ring 48. After the assembly process fuel can flow through the fuel injector cup 30 into the fuel inlet portion 24 of the fuel injector 20 without fuel leakage.

To disassemble the fuel injector 20 from the fuel injector cup 30, the screw element 47 is removed and the fuel injector 20 can be shifted away from the fuel injector cup 30 in axial direction in a way that the second plate element 38 is coming out of engagement with the recess 40 of the first plate element 36. Consequently, the fuel injector cup 30 and the fuel injector 20 can be separated from each other.

The coupling of the fuel injector 20 with the fuel rail 18 by the plate elements 36, 38 and the screw element 47 allow an assembly of the fuel injector 20 and the fuel injector cup 30 without a further metallic contact between the fuel injector 20 and further parts of the internal combustion engine 22.

A sealing between the fuel injector body 21 and a combustion chamber of the internal combustion engine 22 can be carried out by a plastic element, in particular by a PTFE element. Consequently, noise transmission between the fuel injector 20 and further parts of the internal combustion engine can be kept small.

What is claimed is:

1. A coupling device for hydraulically and mechanically coupling a fuel injector to a fuel rail of a combustion engine, the fuel injector having a central longitudinal axis, the coupling device comprising:

a fuel injector cup operable to be hydraulically coupled to the fuel rail and to engage a fuel inlet portion of the fuel injector, a first plate element being fixedly coupled to the fuel injector cup, the first plate element comprising a recess, and a second plate element being fixedly coupled to the fuel injector and being arranged in the recess and being fixedly coupled to the first plate element to retain the fuel injector in the fuel injector cup in direction of the central longitudinal axis, wherein the fuel injector comprises a groove, and a snap ring is arranged in the groove of the fuel injector and is designed to fixedly couple the second plate element to the fuel injector.

2. The coupling device according to claim 1, wherein the second plate element and the recess being shaped in a manner that the second plate element and the recess are forming a positive fitting coupling.

3. The coupling device according to claim 2, wherein the second plate element and the recess being shaped in a manner that the second plate element and the recess are forming a torque proof coupling.

4. The coupling device according to claim 1, wherein the groove of the fuel injector and the snap ring being arranged and designed to form a positive fitting coupling between the second plate element and the fuel injector which is designed to prevent a movement of the second plate element relative to the fuel injector.

5. The coupling device according to claim 1, wherein the first plate element being in one part with the fuel injector cup.

6. The coupling device according to claim 1, wherein the coupling device comprising a single screw element, and the plate elements being designed and arranged to be fixedly coupled with the single screw element.

7. A method for hydraulically and mechanically coupling a fuel injector to a fuel rail of a combustion engine, the fuel injector having a central longitudinal axis, the method comprising:

hydraulically coupling a fuel injector cup to the fuel rail wherein the fuel injector cup engages a fuel inlet portion of the fuel injector, fixedly coupling a first plate element to the fuel injector cup, the first plate element comprising a recess, fixedly coupling a second plate element to the fuel injector and arranging the second plate element in the recess and fixedly coupling the second plate element to the first plate element to retain the fuel injector in the fuel injector cup in direction of the central longitudinal axis, and arranging a snap ring in a groove of the fuel injector to fixedly couple the second plate element to the fuel injector.

8. The method according to claim 7, wherein the second plate element and the recess being shaped in a manner that the second plate element and the recess are foiming a positive fitting coupling.

9. The method according to claim 8, wherein the second plate element and the recess being shaped in a manner that the second plate element and the recess are forming a torque proof coupling.

10. The method according to claim 7, wherein the groove of the fuel injector and the snap ring being arranged and designed to form a positive fitting coupling between the second plate element and the fuel injector which is designed to prevent a movement of the second plate element relative to the fuel injector.

11. The method according to claim 7, wherein the first plate element being in one part with the fuel injector cup.

12. The method according to claim 7, wherein the coupling device comprising a single screw element, and the plate elements being designed and arranged to be fixedly coupled with the single screw element.

13. A coupling device comprising:

a fuel injector cup operable to be hydraulically coupled to a fuel rail and to engage a fuel inlet portion of a fuel injector, a first plate element being fixedly coupled to a fuel injector cup and comprising a recess, a second plate element being fixedly coupled to the fuel injector and being arranged in the recess and being fixedly coupled to the first plate element to retain the fuel injector in the fuel injector cup in direction of a central longitudinal axis of the fuel injector, and a snap ring operable to fixedly couple the second plate element to the fuel injector.

14. The coupling device according to claim 13, wherein the second plate element and the recess being shaped in a manner that the second plate element and the recess are forming a positive fitting coupling.

15. The coupling device according to claim 14, wherein the second plate element and the recess being shaped in a manner that the second plate element and the recess are forming a torque proof coupling.

16. The coupling device according to claim 13, wherein the groove of the fuel injector and the snap ring being arranged and designed to form a positive fitting coupling between the second plate element and the fuel injector which is designed to prevent a movement of the second plate element relative to the fuel injector.

17. The coupling device according to claim 13, wherein the first plate element being in one part with the fuel injector cup.

18. The coupling device according to claim 13, wherein the coupling device comprising a single screw element, and the plate elements being designed and arranged to be fixedly coupled with the single screw element.

* * * * *